United States Patent [19]

Moore

[11] Patent Number: 4,873,908

[45] Date of Patent: Oct. 17, 1989

[54] COLLAPSIBLE ELECTRIC GUITAR

[76] Inventor: James G. Moore, 904 Nickolaus Pl., Woodstock, Ga. 30188

[21] Appl. No.: 227,143

[22] Filed: Aug. 3, 1988

[51] Int. Cl.[4] ..... G10D 3/00

[52] U.S. Cl. ..... 84/291

[58] Field of Search ..... 84/291, 290, 327, 267

[56] References Cited

U.S. PATENT DOCUMENTS

| | | | |
|---|---|---|---|
| 4,073,211 | 2/1978 | Jorgensen | 84/291 |
| 4,111,093 | 9/1978 | Field et al. | 84/291 X |
| 4,254,683 | 3/1981 | Nulman | 84/DIG. 3 X |
| 4,573,391 | 3/1986 | White | 84/291 |
| 4,686,882 | 8/1987 | Shaw | 84/291 |

*Primary Examiner*—L. T. Hix
*Assistant Examiner*—Brian W. Brown
*Attorney, Agent, or Firm*—Needle & Rosenberg

[57] ABSTRACT

An electric guitar has a main body which includes a neck portion. A hinge which connects a control module to the main body enables the main body and control module to be folded together into a more compact form. An outer body has an upper body and rear body and is detachably connected to the main body. The upper body has a flat surface which mates with a corresponding flat surface on the rear body. A machine bolt interconnects the upper and rear bodies and is perpendicular to the flat surfaces which are at selected angles of inclination to allow the upper body to rotate about the bolt and on the surfaces from a position at which it is at a right angle to the rear body to a position at which it is in longitudinal alignment with the rear body. In this position of alignment, the outer body is sufficiently narrow so that it can be placed over and secured to the folded main body and control module and the guitar can fit within a relatively short and narrow.

16 Claims, 2 Drawing Sheets

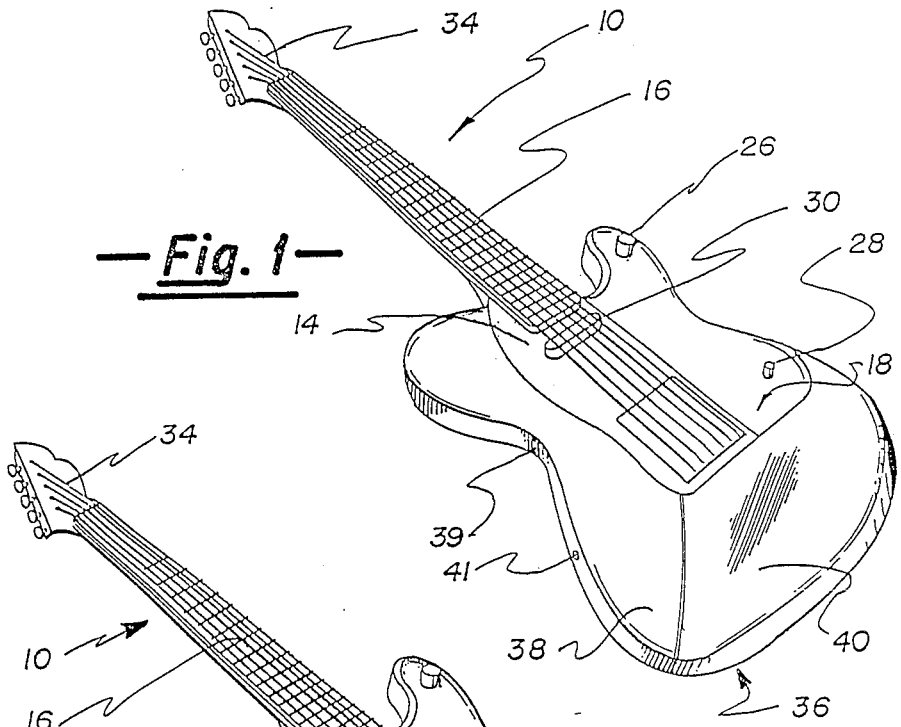
—Fig. 1—
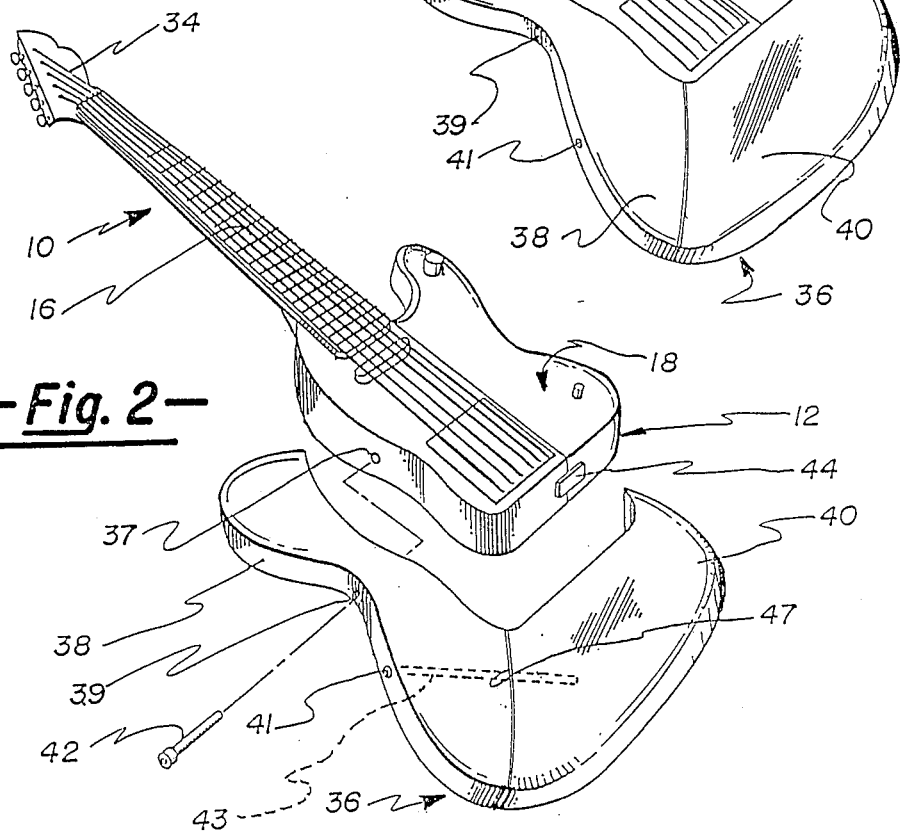
—Fig. 2—

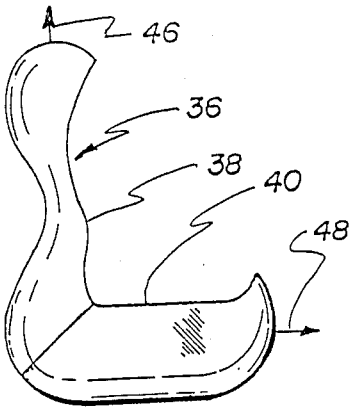
—Fig. 3—
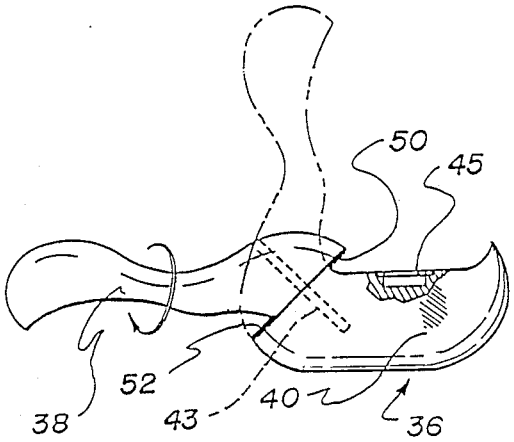
—Fig. 4—
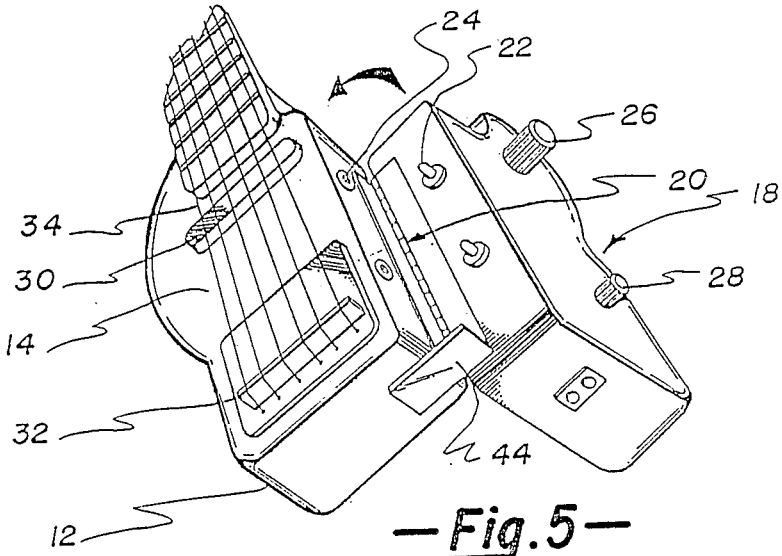
—Fig. 5—

COLLAPSIBLE ELECTRIC GUITAR

BACKGROUND OF THE INVENTION

The present invention relates to stringed musical instruments and more particularly to stringed musical instruments which can be collapsed so as to be conveniently carried, transported, and stored in a more compact form.

Conventional electric guitars come in a variety of shapes and sizes. However, they are generally too large to be conveniently carried and transported, particulary on modern airlines which require the owner to have such guitars transferred with the baggage. Quite often, musicians are forced to purchase an extra seat simply for the guitar, since a modern electric guitar is a somewhat delicate instrument and the owner of such an instrument would prefer that it not be transported with the baggage. In addition, many electric guitars are very valuable or have their own unique attributes which make them irreplaceable to the owner so that the owner does not want to risk having the guitar lost because it was transported with airline baggage. It is also desirable in other situations that the modern electric guitar be made less bulky in order to be more conveniently carried or transported.

Some prior art collapsible guitars have incorporated a hinged neck which allows the neck portion of the guitar to be folded so as to fit into a suitably sized recess in the main body of the guitar. An example of such a device is given in U.S. Pat. No. 4,073,211 to Jorgensen. The Jorgensen guitar also has grooved portions on the main body which receive the guitar strings when the neck is in a folded position in the main body. Although the Jorgensen guitar folds into a relatively compact form instrument, a primary disadvantage exists in that the folding of the neck involves excess lateral displacement of the strings of the instrument resulting in the application of excess tension thereto necessitating that the guitar be retuned after it has been erected into a playable guitar. In addition, the rather large recess in the body of the guitar, and to a lesser extent, the grooves in the guitar body, have a pronounced effect on the resonance and other musical characteristics of the guitar. Consequently, such prior art guitars may not have the desired "sound". Moreover, such prior art guitars cannot be played in their collapsed form.

Another prior art collapsible guitar utilizes mechanisms which relax the strings in order to permit the neck to be folded. An example of such a prior art collapsible guitar is disclosed in U.S. Pat. No. 4,111,093 to Field. The Field guitar employs a somewhat complex system of gears and rollers to relax the string tension and additionally employs a spring loaded pin to lock the neck in an extended position when the instrument is to be played. However, a disadvantage with the Field guitar is that its complexity and its sophisticated mechanisms add to the cost of manufacture of the guitar making the guitar somewhat more expensive than other guitars of comparable musical quality. In addition, such complex mechanisms may adversely affect the tonal characteristics of the guitar. Moreover, as with the Jorgensen guitar, the Field guitar reduces only the length of the musical instrument and retains the original width dimension of the instrument. Thus such prior art guitars are not as dimensionally compact as desired by guitar owners.

Other prior art collapsible guitars have body sections which are foldable or collapsible. An example of such a prior art guitar is given in U.S. Pat. No. 4,686,882 to Shaw. The Shaw guitar has a main body which has wing-like sections at lateral portions thereof. These wing sections are provided with expander mechanisms which include a threaded stem projecting through one wall in order to manually expand the wings out of their collapsed position into their expanded position. In addition, the Shaw guitar also has a neck portion which is folded by means of a hinge over the top of the instrument body. A major disadvantage with such guitars is that folding the strings in order to collapse the guitar requires that the guitar be retuned when erected. Another important disadvantage with such prior art collapsible guitars is that it is required to have a particular shape, i.e. the wings must be in a triangular form so that the guitar is collapsible, as desired. In addition, the somewhat complex mechanical mechanisms tend to both make the guitar more expensive and adversely affect its tonal characteristics.

Still other prior art guitars are composed of separate sections or parts which may be joined together to yield a musical instrument in unitary form. Such a prior art guitar is disclosed in U.S. Pat. No 4,254,683 to Nulman. The Nulman guitar essentially includes two portions, one of which is a neck and fingerboard portion and the other which is a main body section. The main body section has a recess, or socket, to receive the correspondingly shaped portions of the fingerboard and the neck. When assembled, the upper surfaces of the main body and the fingerboard are coplanar. However, such prior art guitars provide only a limited degree of desirability as exhibited by the lack of reduce dimensional size of the component parts and difficulty in assembly, which requires special tools and a certain amount of manual dexterity.

A collapsible electric guitar is thus needed that can be collapsed into a form in which it has reduced length and width. Moreover, a collapsible guitar is needed that has such attributes that consists of a relatively simple design, an easily collapsible form, and the desired tonal characteristics, as well as the ability to be played being playable in its collapsed form.

SUMMARY OF THE INVENTION

It is a principle object of the present invention to provide a guitar which may be collapsed into a form which is convenient to carry.

It is another object of the present invention to provide a collapsible guitar which, in its collapsed form, has substantially reduced length and width.

It is another object of the invention to provide a collapsible guitar which may be played in its collapsed form.

It is an object of the present invention to provide a collapsible guitar which may be collapsed into a compact form allowing it to be placed into a case suitable for carrying over a user's shoulder.

It is another object of the present invention to provide a collapsible guitar which does not have to be retuned or restrung after assembly and after being collapsed.

It is still another object of the present invention to provide a collapsible guitar in which its collapsibility does not adversely affect its tonal characteristics.

The electric guitar of the present invention is specifically designed to be collapsible and easy to carry. This is into two main parts which accomplished by securing the two main parts together and wrapping them in a soft shell case which can be worn on the user's shoulder like a rifle case. When collapsed and inserted in its case, the guitar will fit under the seat or in the overhead compartment of an airplane, eliminating the need to purchase an extra seat for the instrument or having it transported with airline baggage. The guitar is also completely functional when the outer body portions are detached therefrom. The unique compact structure afforded by removal of outer body portions allows the user to easily play the guitar at a moment's notice without having to restring the guitar.

The guitar of the present invention has a main or central body with a neck portion firmly secured thereto. Unlike other prior art collapsible guitars, the guitar strings are always properly connected and under the proper tension since the neck is not connected to the main body portion by hinges. Thus, the guitar does not have to be retuned or restrung after it has been collapsed.

A control module is hingedly connected to the main body portion. The hinged connection allows the control module to be folded back behind the fingerboard portion of the main body. This allows a substantial reduction in the width of the guitar, although increasing its thickness somewhat, when in a collapsed form.

The guitar can be played, if desired, with only the main body, neck, and control module parts described above. However, there is also an outer body portion which gives the guitar its a desired aesthetic appearance and a desired dimensional size and shape to make it easier to hold and play. The outer body portion is connected to the main body by means of a simple machine bolt which penetrates both the outer body and the main body. The outer body is composed of two portions, the upper body and the rear body. A machine bolt penetrating both portions of the main body, the upper body and the rear body, allows the portions to be connected together while also providing the ability to rotate. An important feature of the invention is the rotatability of the upper and rear body portions which allow these portions to be rotated from a generally right angled position to a position of generally longitudinal alignment. This preferred shape of longitudinal alignment allows the outer body to be secured on top of the main body and control module so that the entire guitar, in collapsed form can be inserted into a suitable long and narrow case. When thus collapsed, the guitar is substantially reduced in both length and width, thereby making the guitar very convenient to carry and easily transportable under an airline seat or in the overhead compartment of an airliner, as aforementioned.

The main body and control module are accurately positioned together by means of a pin suitably located on the lower surface of the main body and at the upper surface of the control module. Similarly, the outer body and main body are precisely positioned together by means of a hinge end structure which fits into a recess in the outer body.

The structures of the present invention which provide collapsibility are amenable to electric guitars, acoustic guitars, and other stringed instruments having a variety of shapes. In addition, the collapsible guitar of the present invention is adaptable to various after market accessories such as vibrato bars, pickups, special electronic accessories, and necks.

BRIEF DESCRIPTION OF THE DRAWINGS

FIG. 1 is a perspective view of the guitar of the present invention in its fully assembled state.

FIG. 2 is a partially exploded view of the guitar of FIG. 1 illustrating the connection of the outer body to the main body.

FIG. 3 is a plan view of the outer body of the guitar of FIG. 1.

FIG. 4 is a plan view of the outer body of FIG. 3 illustrating the connection of the components and showing the rotation of the components.

FIG. 5 is a perspective view of the main body and control module of the guitar of FIG. 1 illustrating the hinged connection and the pin and recess positioning means.

DETAILED DESCRIPTION OF THE PREFERRED EMBODIMENT

Referring to the drawings, the guitar of the present invention is generally designated by the numeral 10. The guitar 10 has a main body 12 on the upper surface of which is a fingerboard 14. A neck portion 16 is preferably integral with the main body 12 therewith (or alternatively securely connected thereto). However, the guitar 10 can have a neck 16 which is detachably secured thereto so that the guitar 10 can accommodate after-market necks, as desired.

The main body 12 is rotatably connected to a control module or central body 18 by means of a hinge 20 or other suitable connector. The hinge 20 allows the main body 12 and the control module 18 to be folded together in order to reduce the width of these components of the guitar by approximately one-half thereby making these components significantly narrower and more compact. In its folded form, the fingerboard 14 and the control knobs 26 and 28 of the control module thereon are preferably at the outer surfaces. Pins 22 are provided preferably on the upper, inner surface of the control module 18. Pins 22 are received by recesses 24 at the corresponding lower inner surface of the main body 12 in order to accurately and more securely position the control module 18 on preferably the lower surface of the main body 12. The control module 18 has a pickup switch, volume control, tone control, and output jack.

The main body 12 and neck 16 contain the pickups 30, the bridge 32 and the strings 34. The hot wire (not shown) for each pickup may be connected to a spring loaded contact (not shown) mounted on the inside surface of the main body and control module. A ground wire (not shown) from the pickups may be connected to the bridge and may travel through the hinge to the control module 18. Thus, the main body 12, neck 16 and control module 18 together form an operational musical instrument whch can be played as is. Moreover, the guitar 10 is not subject to tuning problems because the strings and neck are not displaced from their normal operational position when the main body and control module 18 are folded together. These unique structures of the invention thus provide a handy musical instrument which is relatively compact and which can be played instantly.

An outer body 36 provides the guitar with a shape and size that makes it easier to hold and play and additionally may provide desired resonance to the guitar 10 to improve its tonal characteristics. The outer body 36 is preferably composed of an upper body 38 and a rear body 40. The outer body 36 is preferably securely connected to the main body 12 by means of a simple machine bolt 42 or any other suitable connector. The machine bolt 42 passes through a hole 39 in the upper body 38 and penetrates the main body 12 at a threaded hole 37 therein. The outer body 36 may be easily detached from the main body 12 by means of a simple allen wrench and the hole 39 allows the allen wrench easy access to the bolt 42. Since only one connector secures the outer body to the main body, a means is provided for positioning the outer body 36 onto the rear portions of the main body 12 and control module 18 in order to more accurately and more securely position outer body 36 on these main components. This means for positioning is preferably a hinged end portion 44 preferably located at the rear surfaces of the main body 12 and the control module 18. End portion 44 is received by a recess 45 preferably located at the inner surface of the rear body 40, as shown in FIG. 4.

The upper body 38 and rear body 40 are preferably connected together by means of a second machine bolt 43. Bolt 43 passes through hole 41 and into threaded hole 47. Hole 41 also allows access to bolt 43 for loosening, insertion or removal of bolt 43. The upper body 38 is preferably rotatable relative to the rear body 40, and the second machine bolt 43 preferably serves as a rotational axis for the bodies 38 and 40. Bolt 43 is at a selected angle of inclination relative to the longitudinal axis 46 of the upper body 38 and at a selected angle of inclination relative to the longitudinal axis 48 of the rear body 40. These angles of inclination enable the bolt 43 to act as an axis which is selectively angled to allow the bodies 38 and 40 to be rotated from a first, generally dimensionally erect, position suitable for connection to the main body 12 to a second, generally dimensionally collapsed, position suitable for securing (or simply placing) the outer body 36 onto the main body 12 and control module 18 so that the guitar can be in a generally collapsed and more compact form. Bolt 43 preferably passes through approximately central portions of the end surfaces 50 and 52 of bodies 38 and 40. Thus, loosening the second machine bolt 43 allows the upper body to be rotated relative to the rear body from a position in which it is generally at right angles to the rear body into a position in which it is generally in longitudinal alignment therewith, as shown in FIG. 4.

The inner end surface 50 of the upper body 38 is preferrably at a selected angle of inclination relative to the longitudinal axis 46 (axis of reference) of the upper body and the inner end surface 52 of the rear body 40 is preferably at a selected angle of inclination relative to the longitudinal axis 48 (axis of reference) of the rear body to allow rotation generally on the inner end surfaces from an approximate right angle position into an approximate longitudinal alignment position in which axes 46 and 48 are preferably in general alignment. These angles of inclination are preferably approximately 45 degrees and allow the outer body 36 to be generally rigid and stable when its component parts are in the longitudinal alignment position described. These inner end surfaces are preferably flat for smooth relative rotational movement of bodies 38 and 40, although other shapes may also be suitable (for example, the surfaces 50 and 52 may be dished). In addition, the angles of inclination can be other than 45 degrees if it is desired that the upper and rear bodies be less than perfectly aligned, or if the original relative positioning of these component parts is other than at a right angle. Alternatively, bolt 43 may be relatively short or may simply be a relatively flat connector allowing relative rotation of the bodies 38 and 40. Additionally, the second machine bolt can simply separate the outer body further from the rear body in order to accommodate other than flat shapes of the inner end surfaces (for example, the inner end surfaces may be toothed).

Once the upper and rear bodies 38 and 40 have been rotated into alignment, the outer body is generally straight and the outer body does not extend out from the side of the rear body as it would if positioned for fitting onto the main body 12 and control module 18 for assembly of the guitar 10. The outer body 36 is thus in a form in which it can simply be laid on top of the main body 12 and control module 18, which are in turn folded together to provide a collapsed guitar which is much narrower and shorter than its fully assembled form. These reductions in dimensional size allow the guitar 10 to be more conveniently carried and transported when these component parts are strapped or otherwise secured together. In addition, the collapsed guitar 10 can be inserted into a soft casing which can be conveniently worn over the shoulder like a rifle in its case. When the collapsed guitar is thus cased, or simply collapsed and tied together, it will fit under an airliner passenger seat or in the overhead compartment of an airliner. Thus the collapsed guitar eliminates both the need to purchase an extra seat simply to hold the instrument and the need to transport the instrument with the airline baggage. Additionally, the guitar's compact form substantially reduces the transportation cost of such a guitar when the musician is travelling by airliner.

According, there has been provided, in accordance with the invention, a collapsible musical instrument which can be conveniently transported and carried by a user, preferably over his shoulder when in a suitable case, that fully satisfies the objectives set forth above. It is to be understood that all the terms used herein are descriptive rather than limiting. Although the invention has been described in conjunction with the specific embodiment set forth above, many alternative embodiments, modifications, and variations will be apparent to those skilled in the art in light of the disclosure set forth herein. Moreover, although the invention has been specifically described with regard to electric guitars, it is also applicable to many other types of stringed instruments as well. Accordingly, it is intended to include all such alternatives, embodiments, modifications, and variations that fall within the spirit and scope of the invention as set forth in the Claims hereinbelow.

What is claimed:

1. A collapsible guitar, comprising:

a main body having a neck portion;

a central body;

means for rotatably attaching said central body to said main body so that said central body and said main body are foldable together;

an outer body having an upper body and a rear body; means for connecting said upper body to said rear body so that said upper body can be rotated into generally longitudinal alignment with said rear body; and means for detachably connecting said outer body to said main body.

2. The guitar of claim 1 further including a means for accurately positioning said central body on said main body.

3. The guitar of claim 2, wherein said means for positioning includes a pin mounted on said central body and a recess in said main body for receiving said pin when said central body is in the desired position on said main body.

4. The guitar of claim 1 wherein said means for rotatably attaching includes an hinge.

5. The guitar of claim 1 wherein said means for detachably connecting includes a first machine bolt.

6. The guitar of claim 1 wherein said means for rotatably connecting allows rotation of said upper body relative to said rear body about said means for rotatably connecting.

7. The guitar of claim 1 wherein said means for rotatably connecting includes a second machine bolt for connecting said upper body to said rear body, said second connector allowing rotational movement of said upper body relative to said rear body so that said upper body can be rotated from a position in which said outer body is generally disposed for connection to said main body to assemble the guitar to a position in which it is generally in longitudinal alignment with said rear body.

8. A collapsible, stringed musical instrument, comprising:

a main body having a neck portion;

a central body;

means for rotatably attaching said central body to said main body so that said main body and said central body can be folded together into a more dimensionally compact form;

an outer body having an upper body and a rear body, said upper body having an upper end surface and said rear body having a rear end surface mateable with said upper end surface;

means for detachably connecting said outer body to said main body;

means for rotatably connecting said rear body to said upper body, said upper end surface being disposed at a selected angle of inclination relative to a longitudinal axis of said upper body and said rear end surface being inclined relative to a longitudinal axis of said rear body so that said upper body can be rotated relative to said rear body on said upper end surface and on said rear end surface from a position in which said outer body is disposed for connection to said main body to a position in general longitudinal alignment with said rear body for reduction of a dimensional size of said outer body.

9. The stringed instrument of claim 8 further including a means for accurately positioning said central body on said main body.

10. The stringed instrument of claim 9 wherein said means for positioning includes a pin mounted on said central body and said main body having a recess for receiving said pin when said central body is in the desired position on said main body.

11. The stringed instrument of claim 8 wherein said means for rotatably connecting allows rotation of said upper body relative to said rear body about said means for rotatably connecting.

12. The stringed instrument of claim 11 wherein said means for rotatably connecting is disposed at a selected angle of inclination relative to the longitudinal axis of said upper body.

13. The stringed instrument of claim 8 wherein said second connector is located in a central portion of said upper end surface and in a central portion of said rear end surface.

14. The stringed instrument of claim 8 wherein said second connector includes a machine bolt.

15. The stringed instrument of claim 8 wherein said means for detachable connecting includes a second machine bolt.

16. The stringed instrument of claim 8 wherein said upper end surface and said rear end surface are generally flat to enhance smooth rotational relative movement of said upper body and said rear body.

* * * * *